US007262738B2

(12) United States Patent
Ho et al.

(10) Patent No.: US 7,262,738 B2
(45) Date of Patent: Aug. 28, 2007

(54) MULTI-MODE ANTENNA AND MULTI-BAND ANTENNA COMBINATION

(75) Inventors: David Ho, Taipei (TW); Dian Gu, Shanghai (CN); Chih-Chung Hung, Shanghai (CN)

(73) Assignee: Inventec Appliances Corp., Taipei (TW)

( * ) Notice: Subject to any disclaimer, the term of this patent is extended or adjusted under 35 U.S.C. 154(b) by 64 days.

(21) Appl. No.: 11/167,476

(22) Filed: Jun. 28, 2005

(65) Prior Publication Data

US 2006/0050009 A1 Mar. 9, 2006

(30) Foreign Application Priority Data

Sep. 8, 2004 (TW) ..... 93127158 A

(51) Int. Cl.
*H01Q 21/00* (2006.01)

(52) U.S. Cl. ..... 343/725; 343/702

(58) Field of Classification Search ..... 343/725, 343/702, 895, 790, 792; 455/550, 899
See application file for complete search history.

(56) References Cited

U.S. PATENT DOCUMENTS

| | | | | |
|---|---|---|---|---|
| 6,054,966 | A * | 4/2000 | Haapala | 343/895 |
| 6,112,102 | A * | 8/2000 | Zhinong | 455/552.1 |
| 6,140,973 | A * | 10/2000 | Annamaa et al. | 343/790 |
| 6,288,681 | B1 * | 9/2001 | Kim et al. | 343/702 |
| 6,340,954 | B1 * | 1/2002 | Annamaa et al. | 343/895 |
| 6,816,128 | B1 * | 11/2004 | Jennings | 343/915 |
| 2004/0189535 | A1 * | 9/2004 | Kim | 343/702 |

* cited by examiner

*Primary Examiner*—Hoanganh Le
*Assistant Examiner*—Huedung Mancuso
(74) *Attorney, Agent, or Firm*—Bacon & Thomas, PLLC

(57) ABSTRACT

The present invention is to provide a combination antenna having multi-mode and multi-band arrangements, which comprises a conductive seat; a non-uniform helical antenna extending from one end of the conductive seat; and a pole antenna extending from one end of the conductive seat through the helical antenna, enabling to be tuned to three or more resonant frequencies through tuning the helical antenna to a plurality of resonant frequencies and tuning the pole antenna to a plurality of resonant frequencies different from that to which the helical antenna is tuned.

6 Claims, 5 Drawing Sheets

MULTI-MODE ANTENNA AND MULTI-BAND ANTENNA COMBINATION

FIELD OF THE INVENTION

The present invention relates to multi-band antennas, more particularly to a multi-mode antenna and multi-band antenna combination by disposing a helical antenna and a pole antenna on a conductive seat, enabling the combination antenna to be tuned to three or more resonant frequencies.

BACKGROUND OF THE INVENTION

A wide variety of portable communication products (e.g., cellular phones, PDAs (personal digital assistants), Internet phones, etc.) are commercially available in an even faster pace in recent years as electronics industry advances. Moreover, such portable communication products are provided with many advanced features. Each group of the portable communication products is able to operate in predetermined frequencies due to its specific functions and wireless communication system involved. Currently, dominant wireless communication systems are GSM (Global System for Mobile Communications) (i.e., so-called Pan-European digital mobile phone system) and CDMA (Code Division Multiple Access). For GSM, its frequency bands are 850 MHz, 900 MHz, 1800 MHz, and 1900 MHz. For CDMA, its frequency bands are 800 MHz and 1900 MHz.

Different wireless communication systems are currently employed throughout the world. Thus, a cellular phone user may have to carry another type of cellular phone if he/she travels to another country due to different specifications. For example, GSM is employed in USA and its frequency bands are 850 MHz and 1900 MHz, GSM is employed in European countries and its frequency bands are 900 MHz and 1800 MHz, CDMA is employed in Korea and its frequency bands are 800 MHz and 1900 MHz, GSM is employed in Australia and its frequency bands are 900 MHz and 1800 MHz, and GSM is employed in South East Asian countries and its frequency bands are 900 MHz and 1800 MHz respectively.

In view of the above discussion, cellular phones of single operating frequency are somewhat outdated. Currently, a number of major portable communication product manufacturers (e.g., Motorola, Nokia, Sony Ericson, etc.) have developed dual-band or triple-band portable communication products (e.g., triple-band cellular phones) for solving the above drawback. For a triple-band cellular phone, it is capable of operating in bands including 900 MHz, 1800 MHz, 1900 MHz, and 2.4 GHz and is adapted to operate in GSM, CDMA, or wireless Internet. Alternatively, it can be used as a PHS (Personal Handy-phone System) or Bluetooth cellular phone, or can operate in GPS (Global Positioning System) or other wireless networks. By using the triple-band cellular phone, a user does not have to change his/her cellular phone or any carried portable communication product when the user travels from one country to another country.

For a multi-mode portable communication product employing dual-band or triple-band for operating in bands including 1800 MHz, 1900 MHz, and 2.4 GHz, the most important component thereof is antenna. For example, U.S. Pat. No. 6,112,102 discloses a multi-band non-uniform helical antenna as shown in FIG. 1. The helical antenna 1 comprises a first coil section 10 and a second coil section 20 having a spiral angle, a coil diameter, a length, turns, and a pitch all different from that of the first coil section 10. Thus, each of the first and second coil sections 10 and 20 is formed as a helical antenna operating in dual-band or triple-band mode. In a case of the helical antenna 1 installed in a multi-mode portable communication product employing dual-band or triple-band, it is possible of tuning the helical antenna 1 to a plurality of resonant frequencies by changing parameters including spiral angle, coil diameter, length, turns, and pitch of the helical antenna 1. As an end, the purpose of operating in different frequency bands is achieved.

Taiwanese Patent No. 549,621 discloses a multi-band helical antenna for communication equipment as improvement of U.S. Pat. No. 6,112,102 entitled "Multi-band Non-uniform Helical Antenna". As discussed in background of the Taiwanese Patent No. 549,621, predetermined parameters such as spiral angle and pitch of the antenna in U.S. Pat. No. 6,112,102 may be changed due to carelessness in the manufacturing process. Thus, in often times the antenna in U.S. Pat. No. 6,112,102 either may not be able to operate normally in receiving or transmitting signals or cannot achieve the performance of a desired multi-band antenna. Therefore, a positioning member 2 is provided in a helical antenna 1 as disclosed in Taiwanese Patent No. 549,621 in which the positioning member 2 is firmly retained in the antenna 1 and thus the antenna 1 is able to operate in a third frequency band as shown in FIG. 2.

Above Taiwanese Patent No. 549,621 entitled "Multi-band Helical Antenna for Communication Equipment" employs the positioning member 2 as means for operating in a third frequency band in which the positioning member 2 comprises a metal patch 20 on its surface for cooperating with the helical coils. That is, the purpose of tuning the antenna 1 to a plurality of resonant frequencies by the positioning member 2 depends on parameters of the helical antenna 1. This means that location and shape of the metal patch 20 are constrained by the antenna 1. That is, the provision of the positioning member 2 is trouble-prone and unreliable in use. For example, a plurality of recesses 22 on both sides of the positioning member 2 must be conformed to coil pitches. Incorrect location of the recesses 22 will cause incompatibility of the antenna 1 and the positioning member 2. As a result, it is impossible of tuning the antenna 1 to a plurality of resonant frequencies during operation. Moreover, shapes of the recesses 22 must be snugly fitted between two adjacent coils. It is impossible of fastening the antenna 1 in the recesses 22 if the recess 22 is sufficiently larger than coil pitch. To the contrary, it is also impossible of mounting coils of the antenna 1 in the recesses 22 if the recess 22 is much smaller than coil pitch. Thus, the need for improvement still exists.

SUMMARY OF THE INVENTION

After considerable research and experimentation, a multi-mode antenna and multi-band antenna combination according to the present invention has been devised so as to overcome the above drawbacks of the prior art.

It is an object of the present invention to provide a combination antenna having multi-mode and multi-band arrangements, comprising a conductive seat; a non-uniform helical antenna extending from one end of the conductive seat; and a pole antenna extending from one end of the conductive seat through the helical antenna. It is possible of tuning the helical antenna to a plurality of resonant frequencies and tuning the pole antenna to a plurality of resonant frequencies different from that to which the helical antenna is adapted to be tined. By utilizing this combination antenna, it is possible of tuning the combination antenna to three or more resonant frequencies.

In one aspect of the present invention the helical antenna comprises a first coil section and a second coil section having a plurality of physical parameters different from that of the first coil section such that the first coil section is adapted to be tuned to a plurality of resonant frequencies different from that to which the second coil section is adapted to be tuned. Further, the resonant frequencies to which each of the first and second coil sections is adapted to be tuned are different from that to which the dipole antenna is tuned.

In another aspect of the present invention it is adapted to adjust a plurality of physical parameters of the pole antenna for tuning the pole antenna to a plurality of resonant frequencies different from that to which the helical antenna is tuned.

The above and other objects, features and advantages of the present invention will become apparent from the following detailed description taken with the accompanying drawings.

DETAILED DESCRIPTION OF THE PREFERRED EMBODIMENTS

Figure 1:
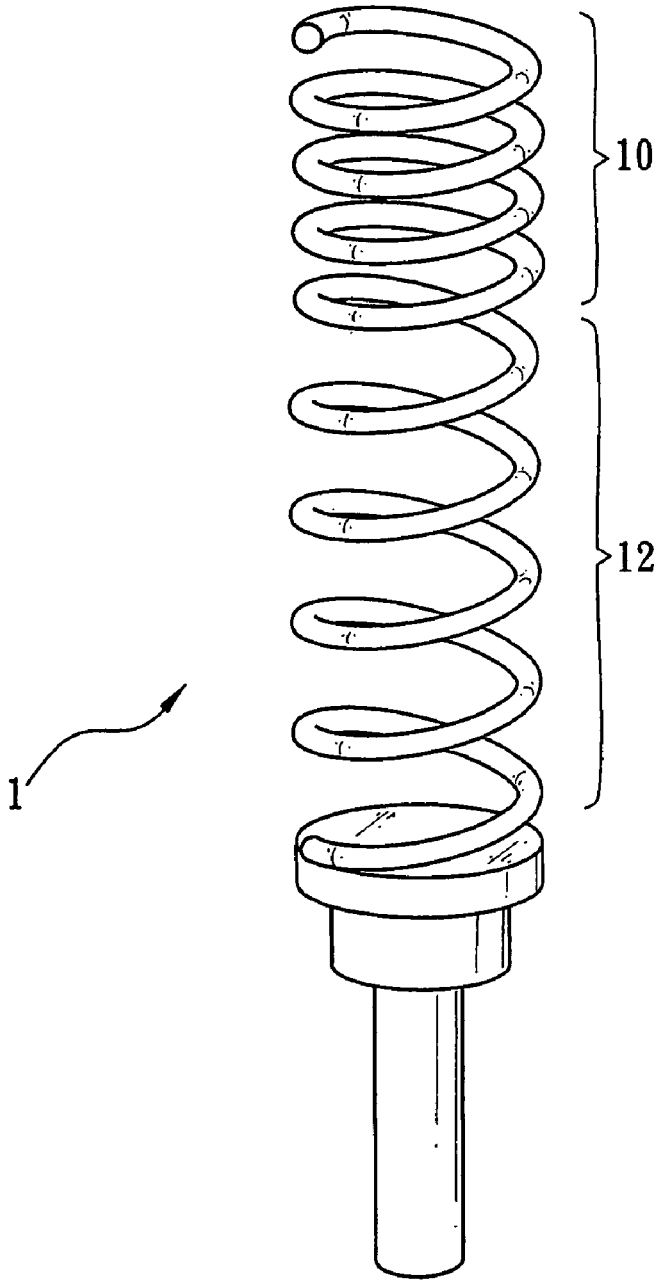
FIG. 1 (Prior Art)
FIG. 1 is a perspective view of a multi-band non-uniform helical antenna disclosed in U.S. Pat. No. 6,112,102.
Figure 2:
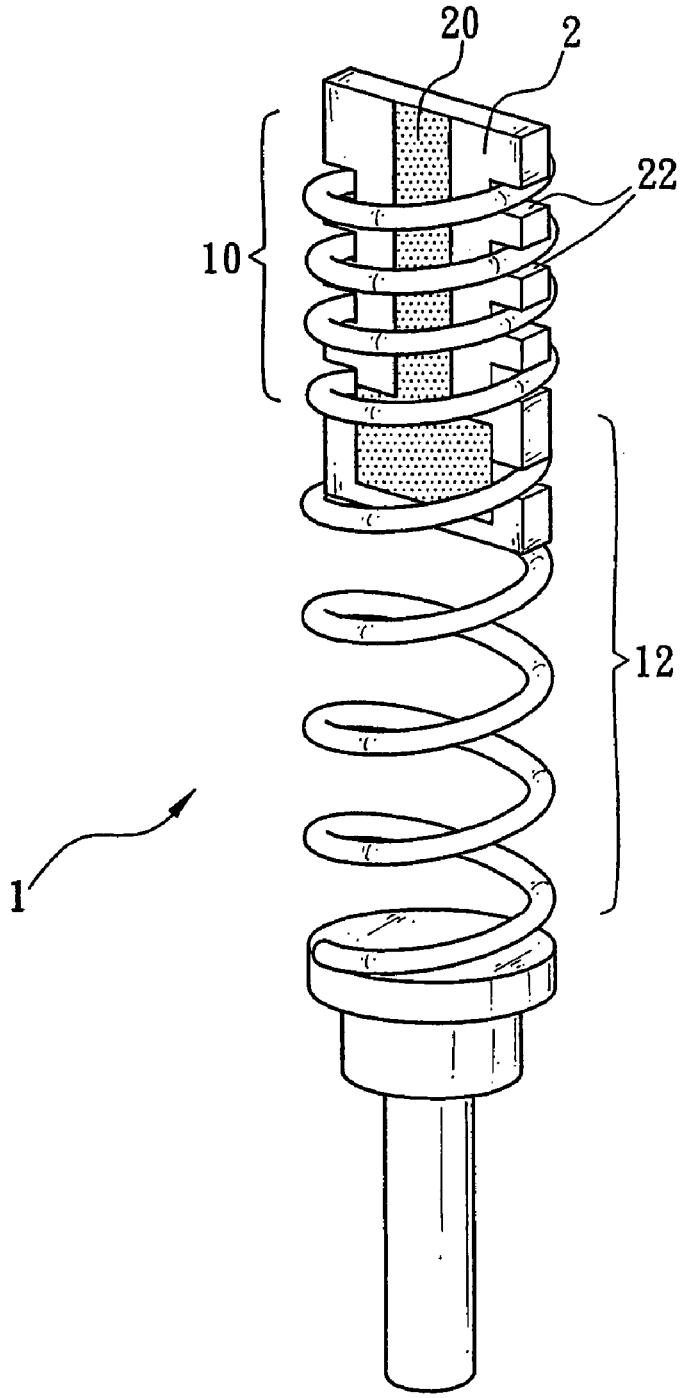
FIG. 2 (Prior Art)
FIG. 2 is a perspective view of a multi-band helical antenna for communication equipment disclosed in Taiwanese Patent No. 549,621.
Figure 3:
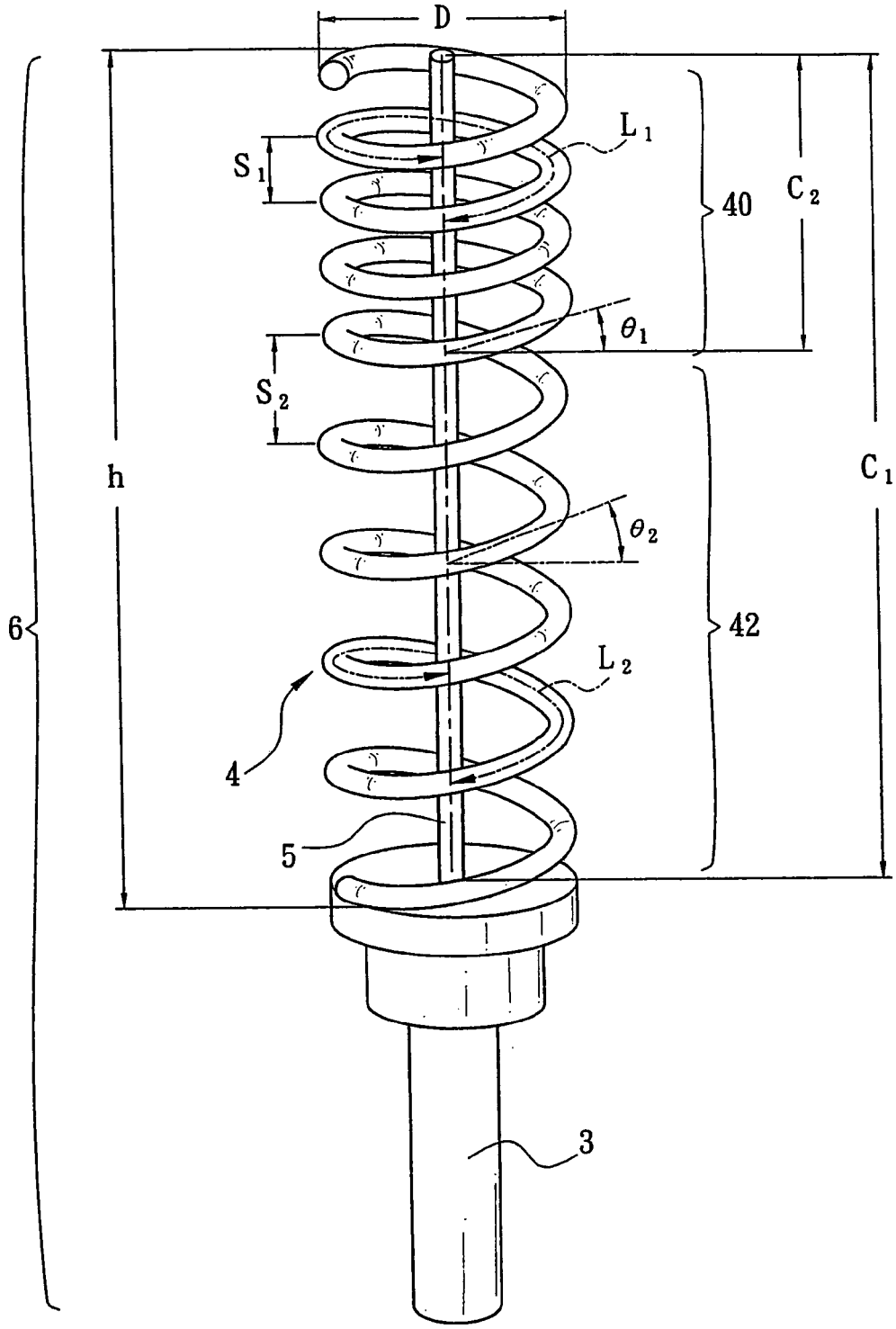
FIG. 3 is a perspective view of a preferred embodiment of antenna according to the invention.

Referring to FIG. 3, there is shown a multi-mode antenna and multi-band antenna combination (i.e., combination antenna) 6 according to a preferred embodiment of the invention. It comprises a cylindrical conductive seat 3 and a non-uniform helical antenna 4 extending from one end of the conductive seat 3. The helical antenna 4 comprises a first coil section 40 and a second coil section 42 having physical parameters including spiral angle, coil diameter, length, turns, and pitch all different from that of the first coil section 40. Thus, it is possible of tuning the first coil section 40 to a plurality of resonant frequencies different from that to which the second coil section 42 is tuned. A pole antenna 5 is extending from one end of the conductive seat 3 through a central axis of the helical antenna 4. It is possible of adjusting physical parameters including diameter and length of the pole antenna 5 for tuning the pole antenna 5 to a plurality of resonant frequencies different from that to which the helical antenna 4 is tuned. By configuring as above, it is possible of tuning the helical antenna 4 to two or more resonant frequencies and it is also possible of tuning the pole antenna 5 to a plurality of resonant frequencies different from that to which the helical antenna 4 is tuned. As an end, it is possible of tuning the combination antenna 6 to three or more resonant frequencies.

It is clear from above that combination antenna 6 does not employ the well known positioning member or a similar element for fastening the helical antenna 4 since as stated in the background the recesses of the positioning member tend to cause trouble in the manufacturing process. To the contrary a number of advantages can be obtained by replacing the positioning member with the pole antenna 5 of the invention as detailed below.

(i) The installation of pole antenna 5 is fast and convenient and no mounting of pole antenna 5 in the helical antenna 4 is required.

(ii) After many experiments, the present inventor finds that predetermined spiral angle and pitch of the helical antenna 4 will not be adversely affected when the helical antenna 4 is subjected to the current manufacturing process. But this does not include a permanent deformation of the helical antenna 4 caused by accidental collision or collision on purpose since it is not anticipated at the time of filing the patent application. In other words, the prior positioning member is not a requisite element for the improvement of non-uniform helical antenna. Advantageously, the purpose of tuning the combination antenna 6 to a plurality of resonant frequencies different from that to which the helical antenna 4 is tuned is achieved by incorporating the pole antenna 5 in the combination antenna 6 as contemplated by the invention.

(iii) A metal patch is formed in the prior positioning member and it is a time consuming and complicated process. To the contrary, it is possible of easily tuning the combination antenna 6 to a plurality of resonant frequencies by changing length or diameter of the pole antenna 5. As a result, both manufacturing time and cost are reduced significantly.

Figure 4:
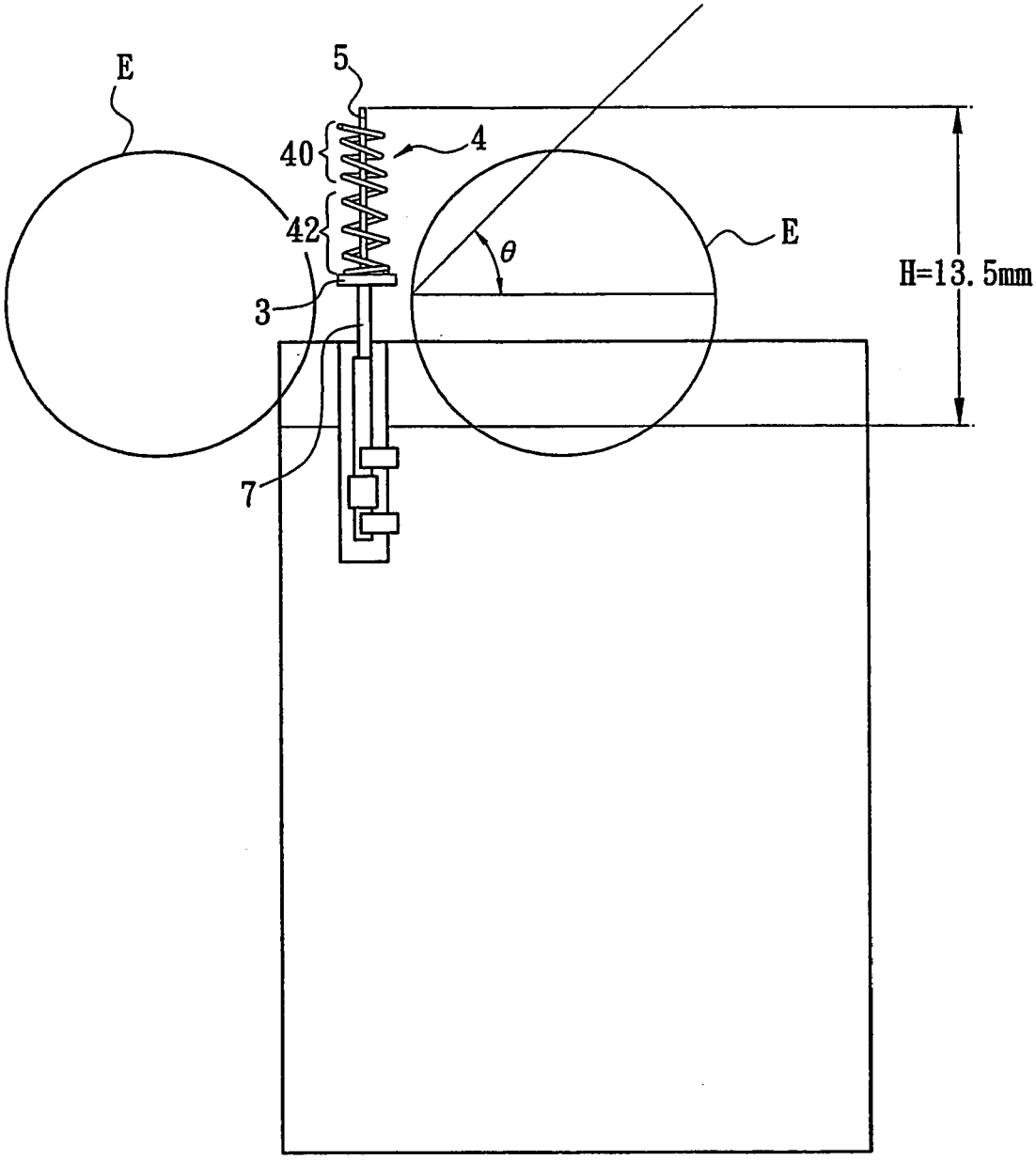
FIG. 4 is environmental view of the antenna of FIG. 3 mounted in a wireless communication product.

Referring to FIG. 3, in a preferred embodiment of the invention a spiral angle $\theta_1$ of the first coil section 40 of the helical antenna 4 is less than a spiral angle $\theta_2$ of the second coil section 40 thereof. Thus, a pitch $S_1$ of the first coil section 40 is less than a pitch $S_2$ of the second coil section 42. Further, each of the first coil section 40 and the second coil section 42 of the helical antenna 4 can be substantially viewed as one consisting of N stacked, connected rings. That is, the antenna is comprised of a plurality of coiled portions. As shown, the upper first coil section 40 of the helical antenna 4 has its coils arranged in a more dense manner as compared to that in the lower second coil section 42 (i.e., pitch of the first coil section 40 is smaller than that of the second coil section 42). In other words, two different coil arrangements are embodied to configure the helical antenna 4 as a distributive, inductive antenna so as to be able to operate in two frequencies. The characteristic of the helical antenna 4 depends on a ratio ($D/\lambda$) of coil diameter D to wavelength $\lambda$ and the ratio $D/\lambda$ is preferably less than 1.8. Accordingly, this is a normal mode helix as shown in a circle E (i.e., E face) in FIG. 4. D is average coil diameter. S is pitch. h is axial length. I is average length of coil. $\theta$ is spiral angle. N is the number of turns. A is area of each ring (i.e., each coil is viewed as a ring). Electric field and direction coefficients of E face are represented as below.

$$\left.\begin{aligned} l^2 = S^2 + (\pi D)^2 = \left(\frac{S}{\mathrm{Sin}\theta}\right)^2 \\ h = NS \end{aligned}\right\} \quad \begin{aligned} E_\varphi &= \frac{120\pi^2 I}{r}\frac{A}{\lambda^2}\mathrm{Sin}\theta \\ E_\theta &= j\frac{60\pi I}{r}\frac{S}{\lambda}\mathrm{Sin}\theta \end{aligned}$$

Figure 5:
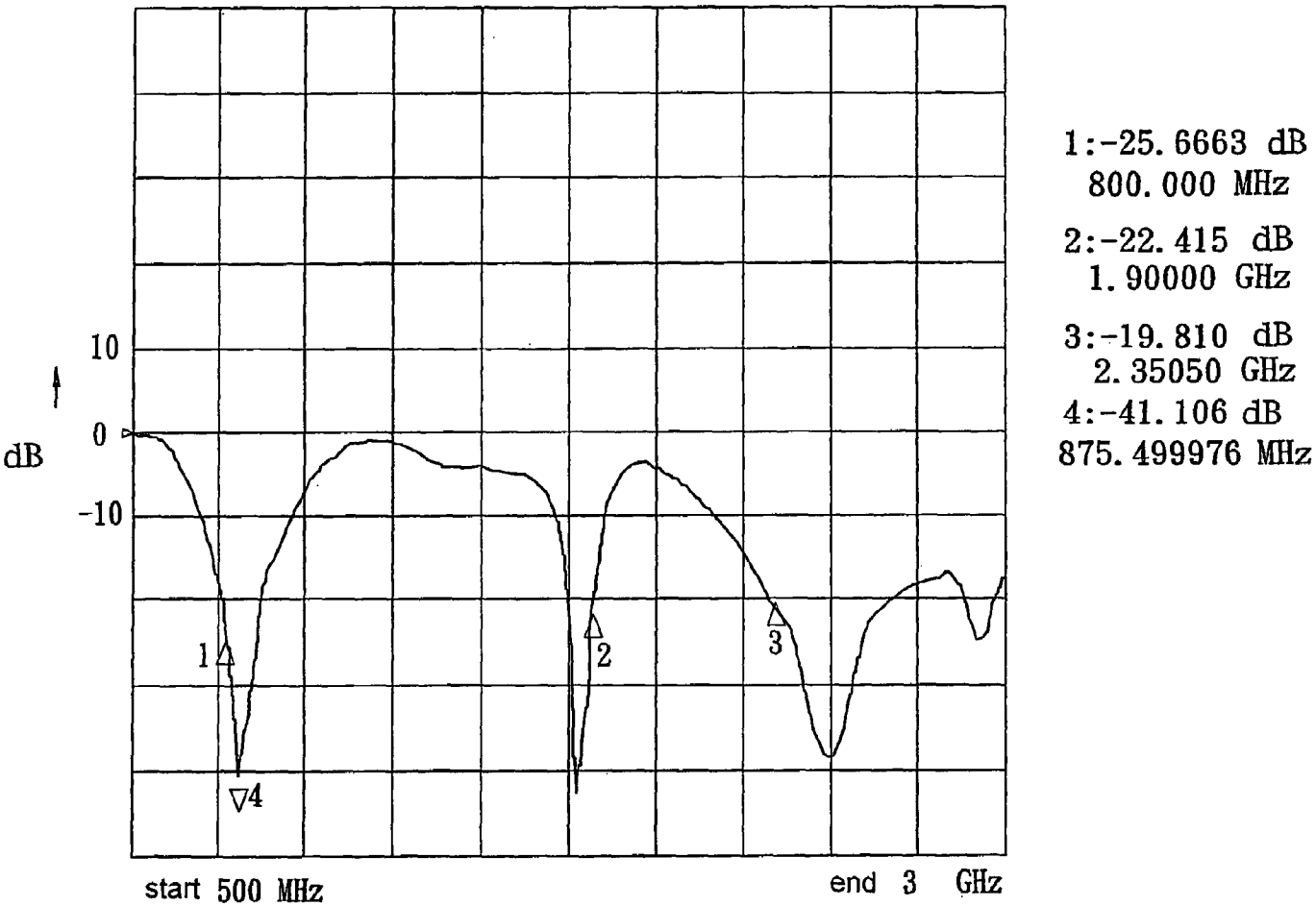
FIG. 5 is a graph showing operating frequency and decibel (DB) of the antenna of the preferred embodiment of the invention measured during operation.

The helical antenna 4 is comprised of four coils of the first coil section 40 (i.e., $L_1$ (average length of coil in the first coil section 40)$\times N_1$, $N_1$ is equal to 4) and five coils of the second coil section 42 (i.e., $L_2$ (average length of coil in the second coil section 42)×$N_2$, $N_2$ is equal to 5). That is, the helical antenna 4 is a first unit $C_1$ having nine coils. Total length h of the first and second coil sections 40 and 42 is h (i.e., equal to $S_1 \times N_1 + S_2 \times N_2$) and which is equal to that of the second unit $C_2$ having four coils. It is possible of tuning the helical antenna 4 to two resonant frequencies due to the constituent first and second units $C_1$ and $C_2$. Hence, there are two length measurements of the helical antenna in which one is coil length of the helical antenna (i.e., $L_1 \times N_1 + L_2 \times N_2$) and the other one is equivalent length h thereof (i.e., $S_1 \times N_1 + S_2 \times N_2$) and which corresponds to an operating frequency. In the invention, the helical antenna 4 is adapted to operate in resonant bands from 850 MHz to 950 MHz and in resonant frequencies from 1800 MHz to 1900 MHz with four resonant frequencies as shown in the graph of FIG. 5. Each unit consists of a coil and a basic radiation element. Current flow in one unit can be seen the same as any of other units since coil diameter is very small. Current flow along axis of coils can be represented as a sinusoidal wave based on antenna principles and experimentation. This is a slow wave in which electromagnetic waves propagate along axis of antenna.

In the embodiment, the pole antenna 5 is adapted to operate in 2.4 GHz in ISM (industrial, scientific, medical) fields and is served as a monopole antenna of one quarter wavelength (λ) mounted on a PCB (printed circuit board). A radiation element of half wavelength is created by the pole antenna 5 and the PCB. Electric field and direction coefficients of E face of pole antenna 5 are represented as below.

$$E_\theta = \int_{-l}^{l} dE_\theta = j\frac{60I_m}{r}\frac{\cos(kl\cos\theta) - \cos kl}{\sin\theta}e^{-jkr}$$

$$|E_\theta| = \frac{|f(\theta)|}{|f_{\max}|} = \frac{1}{|f_{\max}|}\left|\frac{\cos(kl\cos\theta - \cos kl)}{\sin\theta}\right|$$

$$|F(\theta)| = \left|\frac{\cos(\frac{\pi}{2}\cos\theta)}{\sin\theta}\right|$$

where $I_m$ is current at valley of equivalent current waveshape, k is propagation constant, and l is equivalent length of monopole. Further, one end of pole antenna 5 is electrically connected to a feed point 7. An equivalent length H of the feed point 7 and the pole antenna 5 is 13.5 mm. It is possible of tuning the pole antenna 5 to a plurality of resonant frequencies different from that to which the helical antenna 4 is tuned due to the combined effect of the pole antenna 5 and the feed point 7 in the equivalent length H.

For the non-uniform helical antenna 4 incorporated in the invention, it is possible of tuning the first coil section 40 having four coils to two or more resonant frequencies different from that to which the second coil section 42 is tuned having five coils. Such characteristic (i.e., shape) has been disclosed in U.S. Pat. No. 6,112,102 entitled "Multiband Non-uniform Helical Antenna". Accordingly, further description thereof is omitted for purpose of brevity. Moreover, it is possible of tuning the combination antenna 6 to three or more resonant frequencies by combining the helical antenna 4 and the pole antenna 5, resulting in the elimination of drawbacks associated with the prior positioning member.

While the invention herein disclosed has been described by means of specific embodiments, numerous modifications and variations could be made thereto by those skilled in the art without departing from the scope and spirit of the invention set forth in the claims.

What is claimed is:

1. A combination antenna having multi-mode and multiband arrangements, comprising:

a conductive seat;

a non-uniform helical antenna extending from one end of the conductive seat, the helical antenna comprising a first coil section and a second coil section, wherein the first coil section has a spiral angle less than a spiral angle of the second coil section, a pitch less than a pitch of the second coil section, and coils arranged in a more dense arrangement as compared to that of the second coil section such that the first coil section is adapted to be tuned to a plurality of resonant frequencies different from that to which the second coil section is adapted to be tuned; and a pole antenna extending from one end of the conductive seat through the helical antenna, a plurality of physical parameters of the pole antenna capable of being adjusted for tuning the pole antenna to a plurality of resonant frequencies different from that to which the helical antenna is tuned, wherein the characteristic of the helical antenna depends on a ratio (D/λ) of coil diameter D to wavelength λ, the ratio D/λ is less than 1.8, and electric field and direction coefficients of the helical antenna are represented as:

$$\left.\begin{aligned} l^2 = S^2 + (\pi D)^2 = \left(\frac{S}{\mathrm{Sin}\theta}\right)^2 \\ h = NS \end{aligned}\right\} \quad \begin{aligned} E_\varphi &= \frac{120\pi^2 I}{r}\frac{A}{\lambda^2}\mathrm{Sin}\theta \\ E_\theta &= j\frac{60\pi I}{r}\frac{S}{\lambda}\mathrm{Sin}\theta \end{aligned}$$

where D is average coil diameter, S is pitch, h is axial length, l is average length of coil, θ is spiral angle, and N is the number of turns.

2. The combination antenna of claim 1 wherein in the helical antenna a first unit consists of a plurality of coils of the first coil section and a plurality of coils of the second coil section, and a second unit consists of a total pitch length of the coils of the first coil section and a total pitch length of the coils of the second coil section, and wherein the helical antenna is adapted to be tuned to two resonant frequencies via the first and second units.

3. The combination antenna of claim 2 wherein the first coil section has five coils and the second coil section has four coils.

4. The combination antenna of claim 1, further comprising a feed point electrically connected to one end of the pole antenna, wherein an equivalent length of the feed point and the pole antenna is formed such that it is adapted to tune the pole antenna to a plurality of resonant frequencies different from that to which the helical antenna is tuned via the pole antenna and the feed point in the equivalent length.

5. A combination antenna having multi-mode and multiband arrangements, comprising:

a conductive seat;

a non-uniform helical antenna extending from one end of the conductive seat, the helical antenna comprising a first coil section and a second coil section having a plurality of physical parameters different from that of the first coil section such that the first coil section is adapted to be tuned to a plurality of resonant frequencies different from that to which the second coil section is adapted to be tuned; and a pole antenna extending from one end of the conductive seat through the helical antenna, a plurality of physical parameters of the pole antenna capable of being adjusted for tuning the pole antenna to a plurality of resonant frequencies different from that to which the helical antenna is tuned, wherein the pole antenna is a monopole antenna of one quarter wavelength (λ) mounted on a PCB, wherein a radiation element of half wavelength is created by the pole antenna and the PCB, and wherein electric field and direction coefficients of the pole antenna are represented as:

$$E_\theta = \int_{-l}^{l} dE_\theta = j\frac{60I_m}{r}\frac{\cos(kl\cos\theta) - \cos kl}{\sin\theta}e^{-jkr}$$

$$|E_\theta| = \frac{|f(\theta)|}{|f_{\max}|} = \frac{1}{|f_{\max}|}\left|\frac{\cos(kl\cos\theta - \cos kl)}{\sin\theta}\right|$$

-continued $$|F(\theta)| = \left|\frac{\cos\left(\frac{\pi}{2}\cos\theta\right)}{\sin\theta}\right|$$

where $I_m$ is current at valley of an equivalent current waveshape, k is propagation constant, and 1 is equivalent length of a monopole.

6. The combination antenna of claim 5, further comprising a feed point electrically connected to one end of the pole antenna, wherein an equivalent length of the feed point and the pole antenna is formed such that it is adapted to tune the pole antenna to a plurality of resonant frequencies different from that to which the helical antenna is tuned via the pole antenna and the feed point in the equivalent length.

* * * * *